US011118125B2

(12) United States Patent
Abdallah

(10) Patent No.: US 11,118,125 B2
(45) Date of Patent: Sep. 14, 2021

(54) JET FUEL TREATING FOR BLENDING COMPATIBILITY

(71) Applicant: EXXONMOBIL RESEARCH AND ENGINEERING COMPANY, Annandale, NJ (US)

(72) Inventor: David J. Abdallah, Moorestown, NJ (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 55 days.

(21) Appl. No.: 15/966,605

(22) Filed: Apr. 30, 2018

(65) Prior Publication Data

US 2018/0312771 A1 Nov. 1, 2018

Related U.S. Application Data

(60) Provisional application No. 62/492,324, filed on May 1, 2017.

(51) Int. Cl.
*C10L 1/06* (2006.01)
*C10G 45/02* (2006.01)
(Continued)

(52) U.S. Cl.
CPC ..... *C10L 1/06* (2013.01); *C10G 17/00* (2013.01); *C10G 25/00* (2013.01); *C10G 45/00* (2013.01);
(Continued)

(58) Field of Classification Search
CPC ..... C10G 17/00; C10G 2300/202; C10G 2300/301; C10G 2400/08; C10G 25/00; C10G 45/00; C10G 45/02; C10L 1/04; C10L 1/06; C10L 2200/0259; C10L 2200/0263; C10L 2200/043; C10L 2270/04; C10L 2290/542; C10L 2290/544
See application file for complete search history.

(56) References Cited

U.S. PATENT DOCUMENTS 2,267,458 A 12/1941 Goldsby
2,425,506 A 8/1947 Bethea
(Continued)

OTHER PUBLICATIONS

The International Search Report and Written Opinion of PCT/US2018/030192 dated Jul. 19, 2018.
(Continued)

*Primary Examiner* — Latosha Hines
(74) *Attorney, Agent, or Firm* — Robert A. Migliorini

(57) ABSTRACT

Methods are provided for treatment of kerosene/jet fuel boiling range fractions, such as previously qualified jet fuel fractions, to allow blending of the kerosene/jet fuel boiling range fractions to produce a jet fuel boiling range blend having a breakpoint that is equal to or greater than the breakpoint of at least one of the kerosene jet fuel boiling range fractions used to form the blend. The breakpoint of the jet fuel boiling range blend can be maintained by treating at least one of the component fractions of the blend and/or by treating the blend to reduce a nitrogen content. The reduced nitrogen content can correspond to a reduced content of total nitrogen and/or a reduced content of unexpected nitrogen compounds.

5 Claims, 10 Drawing Sheets

| | Antek S ppm | Antek N ppm | Z =1 amine ppm Mol wt% | Z=3 amine ppm Mol wt% |
|---|---|---|---|---|
| Component 4A (BP 266°C) | >1000 | 6.6 | 3.5 | 0.6 |
| Blend 1:1 | | | | |
| Component 4B (BP 225°C) | >1000 | 3.7 | 0.5 | 0.0 |

(51) Int. Cl.

| | |
|---|---|
| ***C10G 45/00*** | (2006.01) |
| ***C10L 1/04*** | (2006.01) |
| ***C10G 17/00*** | (2006.01) |
| ***C10G 25/00*** | (2006.01) |

(52) U.S. Cl.

CPC ..... *C10G 45/02* (2013.01); *C10L 1/04* (2013.01); *C10G 2300/202* (2013.01); *C10G 2300/301* (2013.01); *C10G 2400/08* (2013.01); *C10L 2200/0259* (2013.01); *C10L 2200/0263* (2013.01); *C10L 2200/043* (2013.01); *C10L 2270/04* (2013.01); *C10L 2290/542* (2013.01); *C10L 2290/544* (2013.01)

(56) References Cited

U.S. PATENT DOCUMENTS

| | | | | |
|---|---|---|---|---|
| 2,916,446 | A | 12/1959 | Shuman | |
| 3,529,944 | A | 9/1970 | Leas | |
| 2009/0289013 | A1* | 11/2009 | Hoskin | C10G 33/06 210/739 |
| 2010/0270205 | A1* | 10/2010 | Lopez | C10G 47/00 208/17 |
| 2011/0005190 | A1 | 1/2011 | Bauldreay et al. | |
| 2014/0076776 | A1* | 3/2014 | Gaughan | C10G 9/00 208/15 |
| 2015/0041634 | A1* | 2/2015 | Quann | C10G 45/10 250/282 |

OTHER PUBLICATIONS

Striebich et al., "Dependence of fuel properties during blending of iso-paraffinic kerosene and petroleum-derived jet fuel", retrieved from the intemet on Jul. 11, 2018: URL:http://www.dtic.mil/dtic/tr/fulltext/u2/a504691.pdf on Jul. 11, 2018.

Naegeli., "The role of sulfur in the thermal stability of jet fuel", Am. Soc. Mech. Eng., 1999, pp. 1-8, retrieved from the Internet on Jul. 11, 2018: URL:http://proceedings.asmedigitalcollection.asme.org/data/conferences/asmep/81863/v002t02a053-99-gt-298.pdf.

* cited by examiner

2017EM121

| ID | Amine Z=1 | Amine Z=3 | N ppm | S ppm | 275°C Pass/Fail |
|---|---|---|---|---|---|
| Crude kero | 0.0 | 0.0 | 0.4 | 25 | 350 |
| Crude kero | 0.0 | 0.0 | 1.8 | 136 | 280 |
| Crude kero | 0.0 | 0.0 | 1.2 | 118 | 310 |
| Crude kero | 0.0 | 0.0 | 2.6 | 94 | 350 |
| Crude kero | 0.0 | 0.0 | 1.4 | 60 | 280 |
| Jet fuel | 0.0 | 0.0 | 4.1 | 10 | 350 |
| Jet fuel | 0.0 | 0.3 | 1.6 | 480 | 325 |
| Jet fuel | 0.0 | 0.0 | 0.5 | 23 | 350 |
| Jet fuel | 0.0 | 0.0 | 0.4 | 22 | 290 |
| Jet fuel | 0.2 | 0.0 | 4 | 4 | 350 |
| Jet fuel | 0.0 | 0.6 | 2.5 | 190 | 345 |
| Jet fuel | 0.0 | 0.0 | 0.7 | 3 | 350 |
| Jet fuel | 0.0 | 0.0 | 1.7 | 12 | 305 |
| Jet fuel | 0.0 | 0.0 | 1.5 | 1 | 350 |
| Jet fuel | 0.1 | 0.0 | 2.4 | 468 | 310 |
| Jet fuel | 0.0 | 0.0 | 1.4 | 215 | 350 |
| Jet fuel | 0.0 | 0.0 | 2.3 | 4 | 350 |
| Jet fuel | 0.8 | 0.0 | 3.8 | 87 | 0, 0.0 |
| Jet fuel | 0.1 | 0.0 | 0.8 | 4 | 36, 0.0 |
| Jet fuel | 0.8 | 0.1 | 3.9 | 45 | 3, 0.0 |
| Jet fuel | 0.1 | 0.0 | 2.9 | [illegible] | 290 |
| Jet fuel | 0.1 | 0.0 | 1.3 | 743 | 295 |
| Jet fuel | 0.1 | 0.1 | 1.3 | 708 | 295 |
| Jet fuel | 0.2 | 0.2 | 3.5 | 540 | 290 |
| Jet fuel | 0.0 | 0.0 | 1.1 | 838 | 285 |
| Jet fuel | 0.0 | 0.0 | 0.5 | 812 | 295 |
| Jet fuel | 0.2 | 0.1 | 4.9 | 834 | 320 |

| ID | Amine Z=1 | Amine Z=3 | N ppm | S ppm | 275°C Pass/Fail |
|---|---|---|---|---|---|
| Jet fuel | 0.4 | 0.0 | 3.2 | >1000 | 13, 0.1 |
| Jet fuel | 0.5 | 0.0 | 3.7 | >1000 | 9, 0.1 |
| Jet fuel | 0.7 | 0.1 | 4.6 | >1000 | 12, 0.0 |
| Jet fuel | 0.7 | 0.1 | 3.9 | >1000 | 10, 0.1 |
| Jet fuel | 0.6 | 0.1 | 2.2 | >1000 | 5, 0.0 |
| Jet fuel | 0.5 | 0.3 | 1.9 | >1000 | 10, 0.0 |
| Jet fuel | 0.0 | 0.0 | 11.1 | 100 | 275 |
| Jet fuel | 0.0 | 0.0 | 12.2 | <300 | 290 |
| Jet fuel | 0.0 | 0.0 | 9.3 | 120 | 290 |
| Crude kero | 0.0 | 0.0 | 8.3 | 67 | 295 |
| Jet fuel | 0.4 | 0.0 | 22.5 | 1 | 350 |
| Jet fuel | 0.9 | 2.4 | 1.3 | 144 | 350 |
| Crude kero | 0.0 | 7.0 | 4.5 | 386 | 310 |
| Crude kero | 0.0 | 3.0 | 2.6 | 328 | 290 |
| Crude kero | 0.0 | 1.0 | 3.1 | 266 | 345 |
| Crude kero | 0.0 | 2.0 | 4.1 | | 60, 0.0 |
| Jet fuel | 0.2 | 20.1 | 4.6 | 220 | 39, 0.1 |
| Jet fuel | 0.1 | 12.2 | 4.5 | 444 | 7, 0.1 |
| Jet fuel | 1.8 | 9 | 1.6 | 28 | [illegible] |
| Crude kero | 0.2 | 1.0 | 3.7 | >1000 | 285 |
| Jet fuel | 0.0 | 3.0 | 1.6 | 595 | 42, 5.4 |
| Jet fuel | 2.0 | 7.2 | 4.9 | 850 | 275 |
| Crude mix | 0.3 | 14.4 | 0.2 | >1000 | 280, uP |
| Jet fuel | 4.7 | 3.0 | 5.8 | 958 | 83, 12.4 |
| Crude kero | 0.0 | 18.0 | 3.7 | | 270, uP |
| Jet fuel | 0.0 | 30.7 | 5.4 | 370 | max, max |
| Jet fuel | 0.1 | 7.5 | 9.8 | 472 | max, max |

| ID | Amine Z=1 | Amine Z=3 | N ppm | S ppm | 275°C Pass/Fail |
|---|---|---|---|---|---|
| Jet fuel | 0.0 | 2.8 | 1.6 | 28.3 | 110, 4.2 |
| Crude mix | 0.2 | 10.4 | 5.8 | 1000 | 270, uP |
| Jet fuel | 5.3 | 0.1 | 3.3 | 1000 | 94, max |
| Jet fuel | 10.8 | 0.2 | 10.3 | 998 | 147, 0 |
| Destin. | | | | | 260°C Fail |
| *Jet fuel* | 11.1 | 0.2 | 9.4 | 0.0 | max, 28.8 |
| *Jet fuel* | 6.4 | 0.5 | 9.4 | 657 | max, 0.1 |
| *Jet fuel* | 3.7 | 1.2 | 9.8 | 726 | max, 69.5 |
| Jet fuel | 9 | 2 | 8.3 | 769 | 40°, 0.0 |
| Jet fuel | 16.8 | 3.4 | 17.9 | | 50°, 0.2 |
| Jet fuel | 20.4 | 5.1 | 16.3 | | 124°, 0.0 |
| Jet fuel | 3.2 | 4.7 | 9.2 | | 58°, 0.3 |
| Jet fuel | 6.5 | 0.4 | 9.3 | | 60°, 0.4 |
| Jet fuel | 3.2 | 4.4 | 9.6 | | 54°, 2.4 |
| Jet fuel | 4 | 4.6 | 9.5 | | 68°, 0.3 |
| Jet fuel | 1.7 | 4.3 | 8.2 | | 67°, 3.8 |
| Jet fuel | 2.5 | 4.7 | 9 | | 44°, 0.2 |
| Jet fuel | 3.2 | 5.2 | 9.5 | | 61°, 3.5 |
| Jet fuel | 5.2 | 0.2 | 13.2 | 678 | 31°, 1.0 |
| Jet fuel | 5.2 | 0.3 | 7.4 | | 45°, 0.0 |
| Jet fuel | 6.2 | 0.4 | 6.1 | 1133 | 63°, 0.7 |
| Jet fuel | 6.4 | 0.4 | 8 | >1000 | max, 0.3 |
| Jet fuel | 4.5 | 17.3 | 12 | 535 | max, 0.0 |
| *Jet fuel* | 3.7 | 16.8 | 11.1 | 572 | 110, 0.4 |
| *Jet fuel* | 0.2 | 3.0 | 8.9 | 648 | 60, 225 |
| *Jet fuel* | 0.3 | 4.5 | 7.4 | 813 | 11, 164 |

FIG. 3

| | Antek S ppm | Antek N ppm | Z =1 amine ppm Mol wt% | Z=3 amine ppm Mol wt% |
|---|---|---|---|---|
| Component 4A (BP 266°C) | >1000 | 6.6 | 3.5 | 0.6 |
| Blend 1:1 | | | | |
| Component 4B (BP 225°C) | >1000 | 3.7 | 0.5 | 0.0 |

| | Antek S ppm | Antek N ppm | Z =1 amine ppm Mol wt% | Z=3 amine ppm Mol wt% |
|---|---|---|---|---|
| Component 5A (BP 305°C) | >1000 | 3.2 | 0.4 | 0.0 |
| Blend | | | | |
| Component 5B (BP 300°C) | 144 | 1.3 | 0.9 | 2.4 |

| | Antek S ppm | Antek N ppm | Z =1 amine ppm Mol wt% | Z=3 amine ppm Mol wt% |
|---|---|---|---|---|
| Component 6A | 444 | 4.5 | 0.1 | 12.2 |
| Blend 1:1 | | | | |
| Component 6B | >1000 | 3.9 | 0.7 | 0.1 |

JET FUEL TREATING FOR BLENDING COMPATIBILITY

CROSS-REFERENCE TO RELATED APPLICATIONS

This application claims priority to U.S. Provisional Application Ser. No. 62/492,324 filed May 1, 2017, which is herein incorporated by reference in its entirety.

FIELD

This invention relates to methods for characterizing and treating jet fuel blends.

BACKGROUND

Petroleum fractions used for jet fuel are typically qualified, such as based on an ASTM standard (ASTM D3241) to verify the suitability (ASTM D1655) of a petroleum fraction for use. Other qualification standards for jet fuels include UK DEF STAN 91-091 and Canadian Specification CAN/CGSB 3.23. Once a fraction is found to meet the specification from ASTM D1655, it is conventionally assumed that a jet fuel fraction will remain stable over time and therefore will remain within the specification limits. Additionally, it is conventionally assumed that blends of such qualified petroleum fractions will also remain within the specification limits. Subsequent testing is often performed throughout the supply chain to verify that contamination has not occurred during fuel transport.

Many types of crude feedstocks include sulfur and nitrogen compounds that boil in the kerosene boiling range. One option for reducing the amount of sulfur and/or nitrogen compounds can be hydrotreatment of the kerosene boiling range fraction. Such hydrotreatment can be performed on just the kerosene boiling range fraction, or can be performed, for example, on a broader fuels boiling range feed, with subsequent fractionation to separate a desired kerosene fraction from other naphtha and diesel boiling range fractions.

Another option for treatment of kerosene boiling range fractions prior to use as a jet fuel can be a sweetening process such as the Merox™ process. The Merox™ process converts mercaptans present in a fraction to disulfides, but does not necessarily result in any net sulfur removal. The Merox™ process is also generally not effective for removing basic nitrogen compounds such as amines. Other types of sweetening processes are also commercially available, such as the Bender process.

Still another treatment option can correspond to processes involving treatment with caustic or another alkaline solution. Such processes can be effective for at least some sulfur removal from a kerosene fraction, but may have a minimal impact with regard to removal of nitrogen.

U.S. Pat. Nos. 2,425,506, 2,916,446, and 3,529,944 provide early examples of the use of adsorptive clay structures for processing of petroleum fractions during production of jet fuels. The patents describe exposing petroleum fractions to adsorptive clay structures as a second (or later) processing step for removing contaminants from a potential jet fuel fraction. Examples of suitable adsorbent materials can include various types of natural and/or synthetic clays. The clays can correspond to treated or untreated clays. Examples of clays include attapulgite and/or other types of Fuller's earth. Silica gel can also potentially serve as a suitable adsorbent.

Yet another type of treatment can correspond to acid treatment, such as treatment using sulfuric acid. Acid treatment can be effective for removing basic species from a kerosene boiling range fraction, such as basic nitrogen compounds. U.S. Pat. No. 2,267,458 describes a method of performing acid treatment on a cracked naphtha fraction to improve color, sulfur, and gum content. The acid used for the acid treatment is spent sulfuric acid from an alkylation process for forming high octane naphtha compounds.

SUMMARY

In an aspect, a method for preparing a jet fuel boiling range product is provided. The method can include forming a jet fuel boiling range blend comprising a first component and a second component. The first component can have a breakpoint of a first breakpoint temperature or more and the second component can have a breakpoint of a first breakpoint temperature or more. For example, the first component and the second component can both (independently) have a breakpoint of 260° C. or more, or 270° C. or more, or 285° C. or more. The jet fuel boiling range blend can include a sulfur content of about 500 wppm or more, a first nitrogen content, and a breakpoint of less than the first breakpoint temperature. The jet fuel boiling range blend can then be treated to produce a treated blend having a second nitrogen content that is less than the first nitrogen content and having a breakpoint of at least the first breakpoint temperature. The treatment of the jet fuel boiling range blend can optionally include at least one of adsorbent treating, acid treating, and hydroprocessing.

Depending on the aspect, the first nitrogen content and the second nitrogen content can be related to various types of nitrogen-containing compounds within the first component and/or the jet fuel boiling range blend. For example, in some aspects the first nitrogen content can correspond to about 5.0 wppm or more of nitrogen and the second nitrogen content can correspond to less than 5.0 wppm of nitrogen. Additionally or alternately, the first nitrogen content can correspond to about 5.0 molecular wppm or more of nitrogen compounds having a Z class of +1 and/or +3 and the second nitrogen content comprises about 1.0 molecular wppm or less of nitrogen compounds having a Z class of +1 and/or +3.

In some alternative aspects, instead of treating the jet fuel boiling range blend, the first component (corresponding to a first jet fuel boiling range fraction) can be treated prior to blending the first component and the second component. This treatment can be performed in addition to or in place of treatment of the resulting jet fuel blend. In such aspects, the first nitrogen content and the second nitrogen content can correspond to various types of nitrogen in the first component. In such aspects, the second component can include a sulfur content of 700 wppm or more.

In some aspects, the jet fuel boiling range blend, the first component, and/or the second component can have an initial boiling point of about 140° C. or more and a final boiling point of about 300° C. or less, or wherein the jet fuel boiling range blend has a T10 distillation point of about 205° C. or less, or a combination thereof. Additionally or alternately, the first component, the second component, and/or the jet fuel boiling range blend can have micro-separometer ratings of 85 or more. The micro-separometer ratings can correspond to ratings prior to treatment for reduction of nitrogen.

The methods for treating a first component and/or a jet fuel boiling range blend can allow for formation of a variety of jet fuel compositions. In some aspects, a jet fuel composition is provided having an initial boiling point of about 140° C. or more, a final boiling point of about 300° C. or less, a breakpoint of about 260° C. or more, a sulfur content of about 500 wppm or more, about 5.0 wppm or more of nitrogen-containing compounds having a Z class of −10 or less, and about 1.0 wppm or less of nitrogen-containing compounds having a Z class greater than 0.

In some aspects, a jet fuel composition is provided having an initial boiling point of about 140° C. or more, a final boiling point of about 300° C. or less, a breakpoint of 260° C. or more, a sulfur content of about 500 wppm or more, a nitrogen content of about 10 wppm or more, and about 1.0 wppm or less of nitrogen-containing compounds having a Z class greater than 0.

BRIEF DESCRIPTION OF THE FIGURES

FIG. 3 provides a table showing characterization results for various kerosene and jet fuel samples.

DETAILED DESCRIPTION OF THE EMBODIMENTS

Overview

Figure 1:
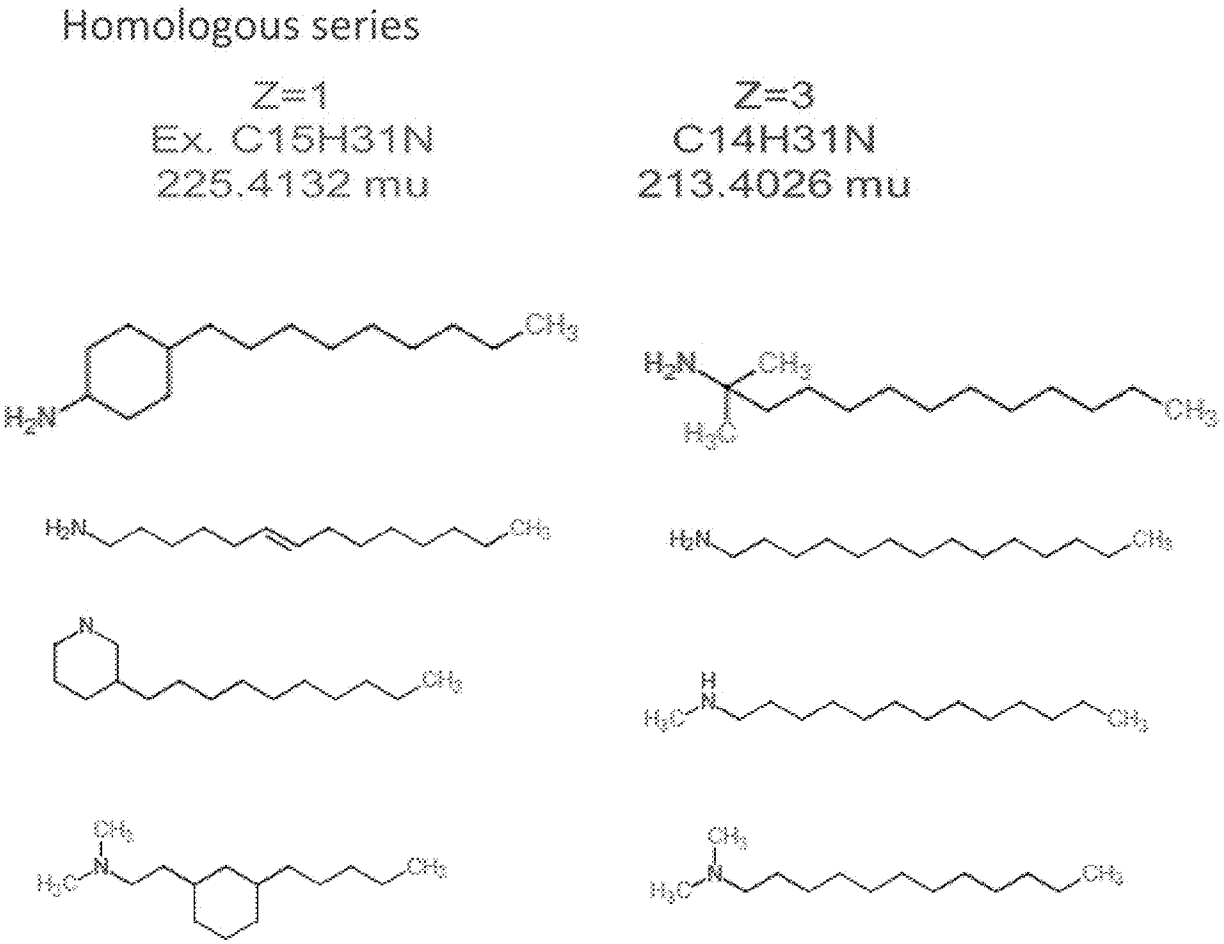
FIG. 1 shows examples of amine isomers having of Z class of +1 or +3 that have the same atomic mass within each series.

In various aspects, methods are provided for treatment of kerosene boiling range fractions, such as previously qualified jet fuel fractions, to allow blending of the kerosene/jet fuel boiling range fractions to produce a jet fuel blend having a breakpoint that is equal to or greater than the breakpoint of at least one of the kerosene boiling range fractions. In other words, methods are provided for treatment of kerosene boiling range fractions to allow blending of the fractions to produce a blend having a minimum thermal stability. Additionally or alternately, methods are provided for treatment of blends of kerosene boiling range fractions, such as blends including one or more previously qualified jet fuel fractions, to produce a treated blend that has a breakpoint that is equal to or greater than the breakpoint of at least one of the components of the blend. Determination of a breakpoint temperature value can be performed, for example, according to ASTM D3241.

Current commercial standards for jet fuels typically specify a variety of properties. Examples of property specifications and/or typical properties for commercial jet fuels include a total acidity of 0.1 mg KOH/g, a sulfur content of 3000 wppm or less, a freezing point of −47° C., a viscosity at −20° C. of 8.0 cSt or less, a flash point of at least 38° C., an initial boiling point of 140° C. or more, a T10 distillation point of 205° C. or less, and/or a final boiling point of 300° C. or less. Another example of a property specification is a specification for a maximum deposit thickness on the surface of a heater tube and/or a maximum pressure increase during a JFTOT test at 260° C., such as a maximum deposit thickness of 85 nm and/or a maximum pressure increase of 25 mm Hg. Still another example of a property specification can be a micro-separometer rating, such as a micro-separometer rating of 85 or more, as measured according to ASTM D3948. A micro-separometer rating provides an indication of the amount of surfactant present in a jet fuel boiling range sample. Petroleum fractions that have an appropriate boiling range and that also satisfy the various requirements for a commercial standard can be tested (such as according to ASTM D3241) and certified for use as jet fuels.

Conventionally, after a jet fuel is certified, the jet fuel can be considered as "on specification" and allowed for use as a jet fuel, either alone or as part of a blend of jet fuels. Unfortunately, certain combinations of jet fuels that separately satisfy jet fuel standards can result in fuel blends that are no longer on specification. In particular, it has been discovered that certain types of jet fuel blends have breakpoints that are below the breakpoints of the component parts of the blend. This unexpected behavior can pose significant difficulties, as routine on-site blending of jet fuels from different sources can potentially result in an undesirable blended jet fuel product.

It has been discovered that fractions that may pose the problem of reduced breakpoint after blending can be identified based on characterization of sulfur content and of certain types of nitrogen content. After blending, the resulting blend of jet fuels can have a sulfur content of about 350 wppm to about 3000 wppm, or about 500 wppm to about 3000 wppm, or about 700 wppm to about 3000 wppm, or about 1000 wppm to about 3000 wppm. The resulting blend of jet fuels can also have an elevated content of unexpected nitrogen compounds. In some aspects, a sufficiently high level of total nitrogen content for a blend may indicate an increased likelihood of the presence of the unexpected nitrogen compounds, such as a total nitrogen content of 5 wppm or more, or 7 wppm or more, or 10 wppm or more, or 15 wppm or more, or 20 wppm or more, or 30 wppm or more, such as up to 75 wppm or possibly still higher.

Additionally or alternately, the unexpected nitrogen compounds in a blend can correspond to and/or be correlated with an elevated content of amines corresponding to a "Z class" greater than 0. The Z class of a compound represents another way to define and/or categorize compositional groups within a petroleum sample, such as a kerosene boiling range fraction, a jet fuel, or a blend of kerosene fractions and/or jet fuels. The Z class is a number based on the concept that the basic ratio of carbon to hydrogen in a hydrocarbon is one carbon per two hydrogens. The Z class represents the deviation of the ratio of carbon to hydrogen in a compound. For example, an alkane has a Z class of +2, since an alkane has a basic formula of $C_nH_{2n+2}$. A compound with one degree of unsaturation and/or one closed ring structure, such as an alkene or a single ring cycloalkane, has a Z class of zero. As more degrees of unsaturation and/or additional rings are included in a compound, the Z class will continue to decrease. For example, benzene has a Z class of −6, corresponding to one ring structure plus three degrees of unsaturation. It is noted that the presence of heteroatoms may also contribute to the Z class number of a compound. In particular, an amine group in a hydrocarbon typically results in one additional hydrogen being present in a structure relative to a corresponding hydrocarbon chain that otherwise has the same number of carbon atoms and same connectivity. Thus, a primary, secondary, or tertiary amine that includes no rings or degrees of unsaturation (i.e., an alkane modified to include a single amine group) has a Z class of +3. Similarly, an amine that includes either a single ring structure or a single degree of unsaturation corresponds to a Z class of +1.

Without being bound by any particular theory, the presence of an elevated content of amines having a Z class of +1 or +3 in a kerosene fraction and/or jet fuel sample is believed to be unusual. Amines having a Z class of +1 or +3 correspond to aliphatic or alicyclic amines that are not naturally present in meaningful amounts in a kerosene fraction. For virgin kerosene fractions, it is believed that the naturally occurring content of amines having a Z class of +1 or +3 is near or below conventional detection limits, which can roughly correspond to 0.1 molecular wppm or less. Instead, amines having a Z class of +1 or +3 are believed to represent compounds that are not normally present in a virgin kerosene fraction. Instead, such compounds are believed to be introduced into a kerosene fraction and/or jet fuel during crude processing or crude transport, although the type of processes resulting in introduction of these compounds is not currently well-understood.

In some aspects, the presence of unexpected nitrogen compounds can correspond to and/or be correlated with an elevated content of amines having a Z class of +1 and/or +3. For example, a jet fuel blend (or other kerosene boiling range sample) can have a content of nitrogen compounds corresponding to a Z class of +3 of 3.0 molecular wppm or more, or 5.0 molecular wppm or more, or 10 molecular wppm or more. As another example, a jet fuel blend/kerosene boiling range sample can have a content of nitrogen compounds corresponding to a Z class of +3 of 1.0 molecular wppm or more in combination with a content of nitrogen compounds corresponding to a Z class of +1 of 5.0 molecular wppm or more, or 7.0 molecular wppm or more, or 10 molecular wppm or more.

In various aspects, the above problems can be overcome be treating at least one of the fractions prior to blending and/or treating the resulting jet fuel blend in order to lower the content of nitrogen compounds having a Z class of +1 and/or +3 in the resulting jet fuel blend. Any convenient treatment that is suitable for reducing the basic nitrogen content of a jet fuel fraction can be used. One option can be to treat a jet fuel fraction by exposing the fraction to an adsorbent, such as attapulgite, Fuller's earth, or another type of adsorbent clay. Another option can be to expose a jet fuel fraction containing unexpected amines to acid treatment. Still another option can be to hydroprocess a jet fuel fraction. After the treatment, the jet fuel blend can have a content of nitrogen-containing compounds with a Z class of +3 of 0.5 molecular wppm or less (or 0.1 molecular wppm or less) and/or a content of nitrogen-containing compounds with a Z class of +1 of 0.5 molecular wppm or less (or 0.1 molecular wppm or less). Additionally or alternately, the content of nitrogen-containing compounds with a Z class of greater than 0 can be 1.0 molecular wppm or less.

As an alternative, rather than forming a blend of jet fuel fractions and then treating the blend, one or more of the individual jet fuel fractions that are intended for use in a blend can be treated so as to avoid forming a blend that has both an elevated content of sulfur and an elevated content of unexpected nitrogen compounds. For example, a first jet fuel fraction can have a sulfur content below 500 wppm, or below 400 wppm, or below 300 wppm, while also having an elevated content of unexpected nitrogen compounds. Although the first jet fuel fraction has an elevated content of unexpected nitrogen compounds, by itself the first jet fuel fraction can have a breakpoint greater than a desired temperature (such as 260° C.) due to the relatively low sulfur content. In some aspects, the presence of the unexpected nitrogen compounds can be inferred based on a total nitrogen content for the first fraction, such as a total nitrogen content of 7 wppm or more, or 10 wppm or more, or 15 wppm or more. In other aspects, the first fraction can contain an elevated content of amines belonging to a Z class greater than 0. For example, the first fraction can have a content of nitrogen compounds corresponding to a Z class of +3 of 5.0 molecular wppm or more, or 7.0 molecular wppm or more, or 10 molecular wppm or more. As another example, the first fraction can have a content of nitrogen compounds corresponding to a Z class of +1 of 5.0 molecular wppm or more, or 7.0 molecular wppm or more, or 10 molecular wppm or more. As still another example, a jet fuel blend/kerosene boiling range sample can have a content of nitrogen compounds corresponding to a Z class of +3 of 1.0 molecular wppm or more in combination with a content of nitrogen compounds corresponding to a Z class of +1 of 5.0 molecular wppm or more, or 7.0 molecular wppm or more, or 10 molecular wppm or more. A second jet fuel fraction may correspond to a fraction with an elevated sulfur content but a low nitrogen content. Such a second jet fuel fraction can have an organic sulfur content of about 500 wppm to about 3000 wppm, or about 700 wppm to about 3000 wppm, or about 1000 wppm to about 3000 wppm. Based on a low content of nitrogen and/or unexpected nitrogen compounds, such a second jet fuel fraction can have a breakpoint that is greater than a desired temperature (such as 260° C.), as determined according to ASTM D3241. Based on the elevated sulfur content of the second fraction and the elevated content of unexpected nitrogen compounds in the first fraction, blends formed from various ratios of the first fraction and the second fraction can correspond to kerosene boiling range and/or jet fuel blends that have a breakpoint that is less than both the breakpoint of the first fraction and the breakpoint of the second fraction.

In the discussion herein, references to a "breakpoint" are references to a JFTOT™ type breakpoint as defined by ASTM D3241. (JFTOT refers to a jet fuel thermal oxidation test defined in ASTM D3241. JFTOT is currently a registered trademark of Petroleum Analyzer Company.)

In the discussion herein, references to a jet fuel "component" are references to a jet fuel boiling range fraction that may correspond to a finished jet fuel product or that may correspond to an unfinished fraction.

In the discussion herein, concentrations of nitrogen or sulfur in a kerosene boiling range sample (such as a jet fuel sample) may be described in units of parts per million by weight, or wppm. Such references to nitrogen or sulfur concentrations in wppm are defined as concentrations based on the weight of nitrogen atoms or sulfur atoms in a sample, as opposed to the weight of compounds containing such nitrogen atoms or sulfur atoms in the sample. In the discussion herein, concentrations of compounds belonging to a Z class in a kerosene boiling range sample (such as a jet fuel sample) may be described in units of molecular parts per million by weight, or molecular wppm. Such references to concentrations of compounds in molecular wppm are defined as concentrations based on the weight of the compounds having the corresponding Z class in the sample.

Stability Testing and Compositional Characterization of Kerosene Fractions and Jet Fuel Products Jet fuel products are generally tested to determine a breakpoint according to a procedure that is defined in ASTM D3241. The test involves flowing a jet fuel sample in an elevated temperature environment over a metal heater tube under specified conditions. For example, a jet fuel sample can be passed from a reservoir over a metal heater tube at a temperature of 260° C. and at a pressure of about 500 psig (3.44 MPag). The output from the metal heater tube is then passed through a differential pressure filter. The flow rate from the reservoir is typically maintained at a constant value, such as 3.0 ml/min for a set period of time, such as 150 minutes. After the test, the deposits on the metal heater tube are evaluated for color and pattern (including thickness of deposit). This establishes a "tube rating" for the test. The maximum pressure drop across the filter is also determined. A proposed jet fuel sample is deemed to pass the test if both the tube rating and pressure drop values are satisfactory.

One option is to test a jet fuel sample at a single temperature, such as 260° C., to qualify the sample for use. Another option is to determine a breakpoint for the sample. One option for identifying a breakpoint can be to perform a series of tests at temperatures that differ by an interval, such as an interval of 5° C. At lower temperatures, the jet fuel sample will pass the tube rating (deposits) and pressure drop tests. As the temperature is increased, a temperature interval will eventually be reached where the sample has satisfactory tube rating and pressure drop values at the temperature on the lower side of the interval while failing one or both of the tube rating and pressure drop portions of the test on the high temperature side of the interval. The lower temperature of the pair of temperatures corresponding to the interval is defined as the breakpoint for the sample. In other words, the breakpoint is a temperature where any further temperature increase is likely to result in failure of the sample to pass the test defined in ASTM D3241.

In addition to determining a breakpoint, compositional details of a kerosene or jet fuel sample can be characterized. One type of characterization can be to determine the sulfur content of a sample, such as according to ASTM D2622. Another type of characterization can be to determine nitrogen content, such as according to ASTM D5291. Still another type of characterization can be to use FTICR to complement the information derived from the above characterization techniques. Briefly, FTICR is a particular type of mass spectrometry that allows for detailed resolution of the composition of a sample. Unlike many types of mass spectrometry, an ion cyclotron resonance mass spectrometer does not detect species based on collisions with a detector. Instead, after forming ions from the species in a sample, the ions are trapped within the magnetic field, resulting in a cyclotron as the ions traverse an (approximately) circular path within the magnetic field. The speed of each ion varies depending on the mass at a given energy. This speed differences allows the electric field generated by different ions traveling in the magnetic field to be detected and distinguished. This time-domain electric signal is converted by Fourier transform into frequency-domain signals that correspond to the different types of ions in the magnetic field. This allows for detailed differentiation between the compounds within a sample. In particular, the frequency-domain signals can be used to determine a weight for each ion, and therefore allow for determination of the stoichiometry of a compound corresponding to a given type of ion. This can allow for assignment of compounds to "Z class" categories.

In order to investigate basic compounds such as amines, positive electrospray ionization Fourier transform ion cyclotron resonance mass spectrometry (PESI-FTICR-MS) was used to determine the Z class for nitrogen-containing compounds in various kerosene and jet fuel samples. The PESI-FTICR-MS technique is well-suited to distinguishing between compounds based on atomic mass. FIG. 1 shows examples of two series of amine isomers that have the same atomic mass. The series in the left column of FIG. 1 correspond to compounds containing a single nitrogen atom that correspond to a Z class of +1. The mass of each of the Z class=+1 compounds is 225.4132 atomic mass units. Based on the atomic mass units, which can be characterized using PESI-FTICR-MS, the stoichiometry of each compound is $C_{15}H_{31}N$. As shown in FIG. 1, each of the compounds in the left column includes either a single ring structure or includes a single olefin ("double bond"). The series in the right column of FIG. 1 corresponds to compounds containing a single nitrogen atom that correspond to a Z class of +3. The mass of each of the Z class=+3 compound is 213.4026 atomic mass units, which corresponds to a stoichiometry of $C_{14}H_{31}N$. As shown in FIG. 1, each compound in the right column corresponds to a saturated amine with no ring structures.

Figure 2:
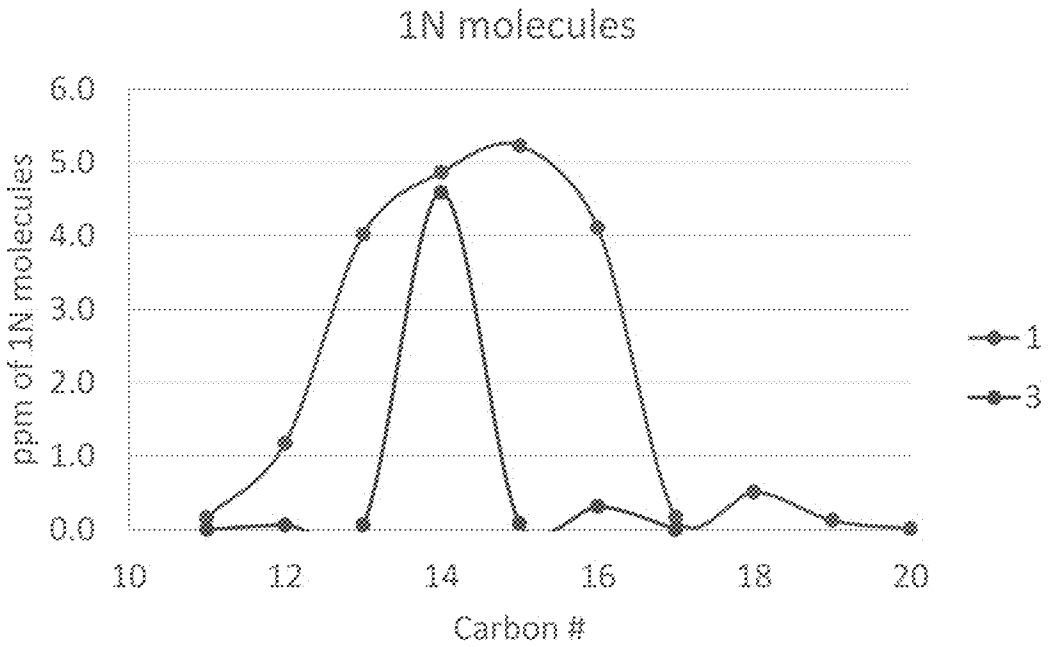
FIG. 2 shows an example of characterization of the Z class of compounds containing a single nitrogen atom using PESI-FTICR-MS.

FIG. 2 shows an example of the type of compositional characterization that can be performed using PESI-FTICR-MS. FIG. 2 shows a plot of the weight (in ppm) of Z class=+1 and Z class=+3 compounds in a jet fuel sample versus the number of carbons in the compound. Based on this type of characterization, the total weight and/or concentration of compounds belonging to a given Z class can be determined for a composition. Additionally or alternately, the concentration of compounds belonging to a Z class that include a desired number (or range) of carbon atoms can be determined.

A combination of characterization techniques were then used to investigate a large number of kerosene fractions, jet fuels, and jet fuel blends to determine if a correlation could be identified between a sample having a breakpoint of at least 260° C. (or at least 275° C.) and the sulfur content, nitrogen content, content of Z class=+1 compounds, and/or Z class=+3 compounds in a sample. FIG. 3 provides a table showing the characterization results. In FIG. 3, references to a "kerosene" fraction are references to jet fuel boiling range material that may not have been tested to qualify as a jet fuel and/or may not have undergone further processing to satisfy a full set of jet fuel specifications. As shown in the first column of Table 3, kerosene fractions and/or jet fuels that have a breakpoint of 275° C. or higher can include a variety of compositions with both low sulfur (less than 500 wppm) and low nitrogen content (less than 4.5 wppm). This first group of samples in the first column of FIG. 3 also include less than 1.0 molecular wppm of compounds having a Z class of Z=+1 and/or Z=+3. A second group of samples that have a breakpoint of 275° C. or more are shown toward the bottom of the first column and continuing at the beginning of the middle column. This second group of samples corresponds to samples having a sulfur content of greater than 500 wppm but less than 4.5 wppm of nitrogen and/or less than 1.0 molecular wppm of compounds having a Z class of +1 or +3. A third group of samples that have a breakpoint of 275° C. or more, shown in the middle column, correspond to samples having more than 5 wppm nitrogen but less than 300 wppm sulfur. It is noted that these samples also have less than 1.0 molecular wppm of compounds corresponding to a Z class of +1 or +3.

These first three groups of samples provide an indication of a range of potentially suitable types of jet fuel fractions for blending. Blends of jet fuels that include less than 300 wppm of sulfur, or that include less than 300 wppm of sulfur and include less than 5 wppm of nitrogen, are believed to correspond to blends that will maintain a desired breakpoint if the component portions of the blend also have a breakpoint equal to or greater than the desired breakpoint.

The middle to bottom portion of the middle column in FIG. 3, along with the first few lines of the right column, shows a series of samples with mixed predictability for having a breakpoint of 275° C. or more. As shown in the middle column, samples with less than 300 wppm sulfur, and usually with less than 500 wppm sulfur, are suitable for achieving a breakpoint of 275° C. or more. The middle column also shows that samples with greater than 500 wppm of sulfur and less than 7 wppm of nitrogen can have a breakpoint of greater than 275° C. under some circumstances. However, the last few samples in the middle column and the first few in the right column show that having greater than 300 wppm sulfur, or greater than 500 wppm sulfur, in combination with a nitrogen content of greater than 5 wppm can cause a sample to have a breakpoint of less than 275° C.

The main portion of the right column in FIG. 3 shows a series of samples that have a breakpoint of less than 260° C. The samples in this portion of the right column include both an elevated sulfur content (greater than 500 wppm, or greater than 700 wppm) and at least one of a) an elevated nitrogen content (greater than 5 wppm, or greater than 7 wppm, or greater than 10 wppm, or greater than 15 wppm); b) an elevated content of compounds with a Z class of +3 (greater than 3.0 molecular wppm, or greater than 5.0 molecular wppm, or greater than 7.0 molecular wppm); c) an elevated content of compounds with a Z class of +1 (greater than 5.0 molecular wppm, or greater than 7.0 molecular wppm, or greater than 10 molecular wppm); and d) greater than 1.0 molecular wppm of Z class=+3 compounds and greater than 3.0 molecular wppm (or greater than 5.0 molecular wppm, or greater than 7.0 molecular wppm) of Z class=+1 compounds.

The middle and right columns in FIG. 3 provide an indication of the types of kerosene and/or jet fuel blends that are susceptible to having a lower breakpoint than the breakpoints of any of the corresponding components of the blend. In particular, blends that may pose difficulties are blends where a first blend component has an elevated sulfur content but a low nitrogen content and/or a low content of compounds with a Z class of +1 or +3 compounds. For such blends, the second component can have a low sulfur content but an elevated content of nitrogen and/or an elevated content of compounds with a Z class of +1 or +3. In such aspects, the sulfur content of the first blend component can be sufficient so that the final blend has a sulfur content of 500 wppm or more, or 700 wppm or more. In such aspects, the nitrogen content of the second blend component can have at least one of a) an elevated nitrogen content (greater than 5 wppm, or greater than 7 wppm, or greater than 10 wppm, or greater than 15 wppm); b) an elevated content of compounds with a Z class of +3 (greater than 3.0 molecular wppm, or greater than 5.0 molecular wppm, or greater than 7.0 molecular wppm); c) an elevated content of compounds with a Z class of +1 (greater than 5.0 molecular wppm, or greater than 7.0 molecular wppm, or greater than 10 molecular wppm); and d) greater than 1.0 molecular wppm of Z class=+3 compounds and greater than 3.0 molecular wppm (or greater than 5.0 molecular wppm, or greater than 7.0 molecular wppm) of Z class=+1 compounds.

In such aspects, the nitrogen content of the first component of the blend can be about 7.0 wppm or more, or about 10 wppm or more, or about 15 wppm or more, or about 20 wppm or more, such as up to about 50 wppm or possibly still higher. Additionally or alternately, the content of compounds with a Z class of +3 can be about 5.0 molecular wppm or more, or about 7.0 molecular wppm or more, or about 10 molecular wppm or more, or about 15 molecular wppm or more, such as up to about 35 molecular wppm or possibly still higher. Additionally or alternately, the content of compounds with a Z class of +1 can be about 7.0 molecular wppm or more, or about 10 molecular wppm or more, or about 15 molecular wppm or more, such as up to about 35 molecular wppm or possibly still higher. It is noted that the above features may be present in combination, such as a first component with a content of compounds with a Z class of +3 of about molecular 5.0 wppm or more and a content of compounds with a Z class of +1 of about molecular 7.0 wppm or more.

In such aspects, the sulfur content of the second component of the blend can be about 700 wppm or more, or about 900 wppm or more, or about 1100 wppm or more, or about 1500 wppm or more, such as up to the typical specification of 3000 wppm or less for a fit-for-purpose jet fuel. It is noted that the amount of the first component in the blend may be less than or greater than the amount of the second component. Additionally, still other components may be present in a blend that have neither elevated sulfur content nor elevated nitrogen content. Thus, the sulfur content of the second component that is needed to produce a blend having an elevated sulfur content may vary depending on the nature of the blend.

It is noted that several of the entries in the right hand column list the word "jet fuel" in italic print. Those entries correspond to samples that were subsequently exposed to acid treatment. After acid treatment, those samples had a breakpoint of 260° C. or more.

Treatment of Kerosene and/or Jet Fractions to Reduce Nitrogen Content

Based on FIG. 3, the difficulties jet fuel blends having a lower breakpoint than the components of the blend can be avoided by reducing either the sulfur content or the nitrogen content of a sample. For sulfur removal, traditional methods of heteroatom removal can be used. For example, hydroprocessing can be effective for reducing the sulfur content of a kerosene or jet fuel boiling range fraction to a desired sulfur level. In some aspects, hydroprocessing can be used to reduce the sulfur content of a kerosene/jet fuel boiling range fraction before blending and/or a resulting blend of jet fuels to a desired level, such as about 500 wppm or less, or about 300 wppm or less, or about 100 wppm or less. Additionally or alternately, hydroprocessing can be used to reduce the mercaptan content of a kerosene/jet fuel boiling range fraction to a desired level. This can be desirable, for example, due to the separate specification that may be imposed on the content of mercaptans in a finished jet fuel. Depending on the initial sulfur level of a sample and/or the type of sulfur, other processes could also be suitable for treatment of a kerosene/jet fuel boiling range sample, such as "sweetening" of a sample using a Merox™ process to convert a portion of the mercaptans in a sample to disulfide compounds.

Additionally or alternately, a jet fuel sample (a blend or a component prior to incorporation into a blend) can be treated to reduce the nitrogen content of the sample. Potential options for reducing the content of (basic) nitrogen impurities in a jet fuel sample can include, but are not limited to, clay treatment, acid treatment, and hydroprocessing.

Clay treatment, or more generally exposure of a jet fuel sample to an adsorbent, can be used to remove a variety of types of impurities from a sample. Suitable adsorbents can include, but are not limited to, natural and/or synthetic clays, Fuller's earth, attapulgite, and silica gels. Such adsorbents are commercially available in various particle sizes and surface areas. It is noted that the effectiveness of an adsorbent for reducing the content of nitrogen/nitrogen compounds in a sample can be dependent on the affinity of the adsorbent for a given compound and/or the prior usage history of the adsorbent. For example, exposing a kerosene boiling range fraction to a clay adsorbent that is loaded with basic nitrogen compounds (such as due to prior adsorption from other kerosene boiling range samples) may result in exchange of nitrogen compounds from the current kerosene boiling range sample for previously adsorbed nitrogen compounds. Similar adsorption/desorption type processes may also occur for other polar compounds that have previously been absorbed by the absorbent.

The conditions employed during clay treatment (or other adsorbent treatment) can vary over a broad range. Treatment with adsorbent can generally be carried out in a temperature range of 0°–100° C. and preferably near ambient conditions, such as 20°–40° C., for a period of time generally ranging from about 1 second to 1 hour. The jet fuel sample can be exposed to the adsorbent in a packed column at any convenient pressure.

Another alternative for removal of basic compounds from a kerosene or jet fuel fraction is acid washing. During acid washing, a feed corresponding to a kerosene or jet fuel sample can be mixed with an aqueous acid solution. Acid can be injected into the feed, for example, at a rate of 6-10 barrels of acid to every thousand barrels of jet fuel. The acid/feed mixture can then pass through a mixing valve, which maintains a mixing differential pressure on the feed of 5-25 psig (35-175 kPag) to sufficiently contact the acid with the sulfur and nitrogen compounds within the jet fuel. The acid/feed mixture can then be routed into the acid coalescer drum. In the coalescer, the acid can be separated from the jet fuel feed using an electrical field that accelerates the rate of separation. The acid settles to the bottom of the drum and can be drawn off on level control. After leaving the coalescer, the acid can be disposed of in any convenient manner, such as sending the acid to offsite storage for resale. It is noted that the sulfuric acid and many types of typical jet fuel feeds are essentially immiscible, so that only minimal amounts of emulsion are typically formed in the acid coalescer. An example of a suitable acid can be a sulfuric acid mixture at a concentration of 80-95 wt %. The remainder of the acid mixture that is not sulfuric acid can be mostly water. Optionally, other components can also be present in the mixture, such as acid soluble oils that may be present if the sulfuric acid corresponds to spent sulfuric acid from another refinery process.

Still another option for upgrading a jet fuel fraction is to hydroprocess the jet fuel fraction. A wide range of hydroprocessing conditions are potentially suitable for use, as even mild hydroprocessing conditions may produce a benefit in the properties of the jet fuel fraction. During hydroprocessing, a feedstock that is partially or entirely composed of a jet fuel boiling range fraction is treated in a hydrotreatment (or other hydroprocessing) reactor that includes one or more hydrotreatment stages or beds. Optionally, the reaction conditions in the hydrotreatment stage(s) can be conditions suitable for reducing the sulfur content of the feedstream, such as conditions suitable for reducing the sulfur content of the feedstream to about 3000 wppm or less, or about 1000 wppm or less, or about 500 wppm or less. The reaction conditions can include an LHSV of 0.1 to 20.0 $hr^{-1}$, a hydrogen partial pressure from about 50 psig (0.34 MPag) to about 3000 psig (20.7 MPag), a treat gas containing at least about 50% hydrogen, and a temperature of from about 450° F. (232° C.) to about 800° F. (427° C.). Preferably, the reaction conditions include an LHSV of from about 0.3 to about 5 $hr^{-1}$, a hydrogen partial pressure from about 100 psig (0.69 MPag) to about 1000 psig (6.9 MPag), and a temperature of from about 700° F. (371° C.) to about 750° F. (399° C.).

Optionally, a hydrotreatment reactor can be used that operates at a relatively low total pressure values, such as total pressures of about 200 psig (1.4 MPag) to about 800 psig (5.5 MPag). For example, the pressure in a stage in the hydrotreatment reactor can be at least about 200 psig (1.4 MPag), or at least about 300 psig (2.1 MPag), or at least about 400 psig (2.8 MPag), or at least about 450 psig (3.1 MPag). The pressure in a stage in the hydrotreatment reactor can be about 800 psig (5.5 MPag) or less, or about 700 psig (4.8 MPag) or less, or about 600 psig (4.1 MPa) or less.

The catalyst in a hydrotreatment stage can be a conventional hydrotreating catalyst, such as a catalyst composed of a Group VIB metal and/or a Group VIII metal on a support. Suitable metals include cobalt, nickel, molybdenum, tungsten, or combinations thereof. Preferred combinations of metals include nickel and molybdenum or nickel, cobalt, and molybdenum. Suitable supports include silica, silica-alumina, alumina, and titania.

In an embodiment, the amount of treat gas delivered to the hydrotreatment stage can be based on the consumption of hydrogen in the stage. The treat gas rate for a hydrotreatment stage can be from about two to about five times the amount of hydrogen consumed per barrel of fresh feed in the stage. A typical hydrotreatment stage can consume from about 50 SCF/B (8.4 $m^3/m^3$) to about 1000 SCF/B (168.5 $m^3/m^3$) of hydrogen, depending on various factors including the nature of the feed being hydrotreated. Thus, the treat gas rate can be from about 100 SCF/B (16.9 $m^3/m^3$) to about 5000 SCF/B (842 $m^3/m^3$). Preferably, the treat gas rate can be from about four to about five time the amount of hydrogen consumed. Note that the above treat gas rates refer to the rate of hydrogen flow. If hydrogen is delivered as part of a gas stream having less than 100% hydrogen, the treat gas rate for the overall gas stream can be proportionally higher.

Example 1—Determining Breakpoints for Jet Fuel Blends

Figure 4:
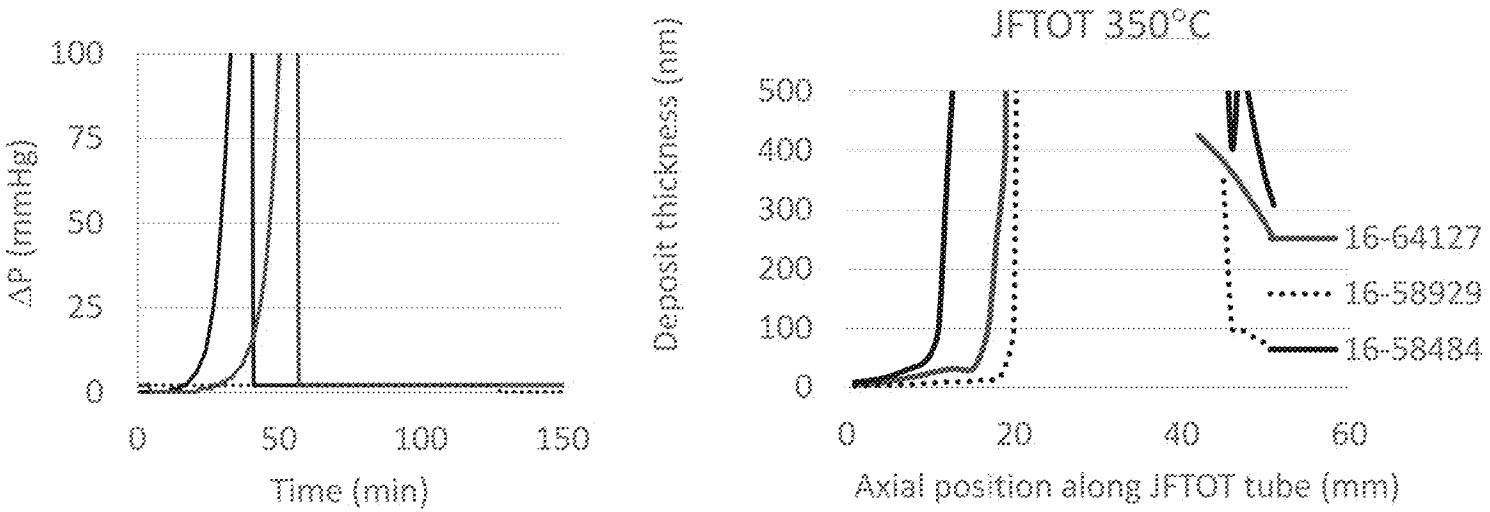
FIG. 4 shows deposit thickness profiles for two jet fuel components and a corresponding 50/50 wt % blend of the components from JFTOT™ testing at 350° C.

For conventional samples, the deposit thickness profile at a given temperature for a blend of two jet fuel components will typically correspond to some type of intermediate or average behavior relative to the deposit thickness profiles for the components in the blend. For example, FIG. 4 shows deposit thickness profiles for two jet fuel components and a corresponding 50/50 wt % blend of the components. The breakpoints for the two components were 269° C. and 225° C., respectively. As shown in FIG. 4, the deposit thickness profile for the blend was between the deposit thickness profiles for the individual components, and corresponded to a breakpoint of 255° C. For the samples in FIG. 4, both components in the blend had relatively high sulfur content (1000 wppm or more) and moderate nitrogen content (6.6 wppm and 3.7 wppm, respectively). Component 4A in FIG. 4 had an elevated content of amine compounds with a Z class of +1 of 3.5 wppm, while component 4B included only 0.5 wppm of compounds with a Z class of +1.

Figure 5:
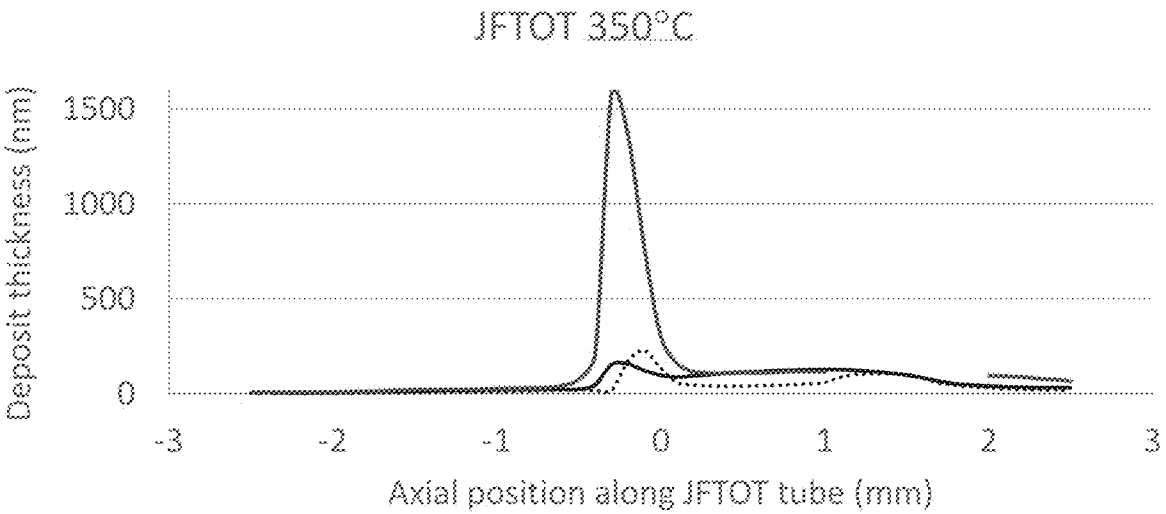
FIG. 5 shows deposit thickness profiles for two jet fuel components and a corresponding 50/50 wt % blend of the components from JFTOT™ testing at 350° C.

In contrast to the expected behavior, FIG. 5 shows an example of j et fuel components that produced a blended product with behavior that was not intermediate to the behavior of the respective components. In the example shown in FIG. 5, component 5A included a relatively high sulfur content (1000 wppm or more) while having a relatively low nitrogen content (3.2 wppm) and little or no content of amines with a Z class of +1 or +3. Component 5B had a low sulfur content (144 wppm) but an elevated content of amines with a Z class of +3. During the JFTOT™ test at 350° C., both of the individual components had roughly 200 nm of deposit accumulation at the maximum location. By contrast, a 50/50 wt % blend of the components resulted in more than 1500 nm of accumulation at the maximum deposit location on the surface of the heater tube. Even though the breakpoint for the blend was only modestly lower (294° C. for the blend, versus 300° C. and 305° C. for the components), the deposit behavior on the surface of the heater tube was sharply different.

Figure 6:
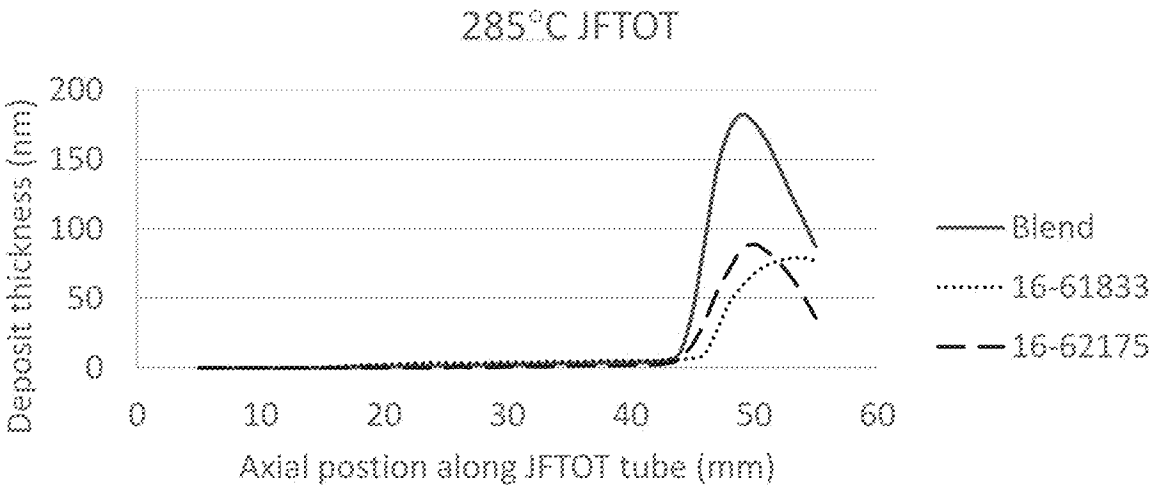
FIG. 6 shows deposit thickness profiles for two jet fuel components and a corresponding 50/50 wt % blend of the components from JFTOT™ testing at 285° C.

As another illustration, the deposit thickness was monitored for JFTOT™ test runs performed at 285° C. for two components and a resulting blend. These results are shown in FIG. 6. Components 6A and 6B both corresponded to jet fuel samples having a breakpoint of 285° C. or more, based on the maximum deposit depth being less than 85 nm at all locations. (The pressure drop also satisfied the specification.) Component 6A corresponded to an intermediate sulfur content (444 wppm) but an elevated content of amines with a Z class of +3 (12.2 wppm). Component 6B corresponded to an elevated sulfur content of more than 1000 wppm, with only 3.9 wppm of total nitrogen and less than 1.0 wppm of amines having a Z class of either +1 or +3. For the blend of components 6A and 6B, however, instead of generating a deposit profile similar to the individual components, the blend resulted in a substantially thicker deposit amount of nearly 200 nm at the maximum location. Thus, FIG. 6 shows an example of two jet fuel components that had a breakpoint of at least 285° C., while the blend of components had a breakpoint of less than 285° C.

Example 2—Treatment of Jet Fuel Blends

Figure 7:
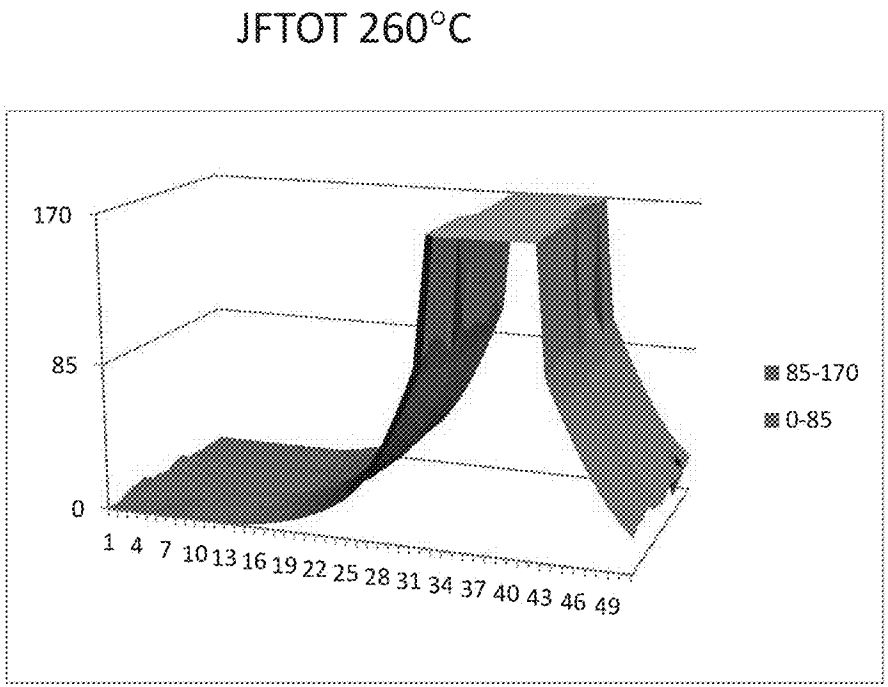
FIG. 7 shows the deposit thickness profile from JFTOT™ testing of a blend of jet fuel components at 260° C.

FIG. 7 shows the deposit thickness profile from JFTOT™ testing of a blend of jet fuel components at 260° C. Although the individual components appeared to have a breakpoint of 260° C. or more based on the components previously having been deemed suitable for transport by pipeline, FIG. 7 shows that the blend resulted in a maximum deposit depth greater than 125 nm.

Figure 8:
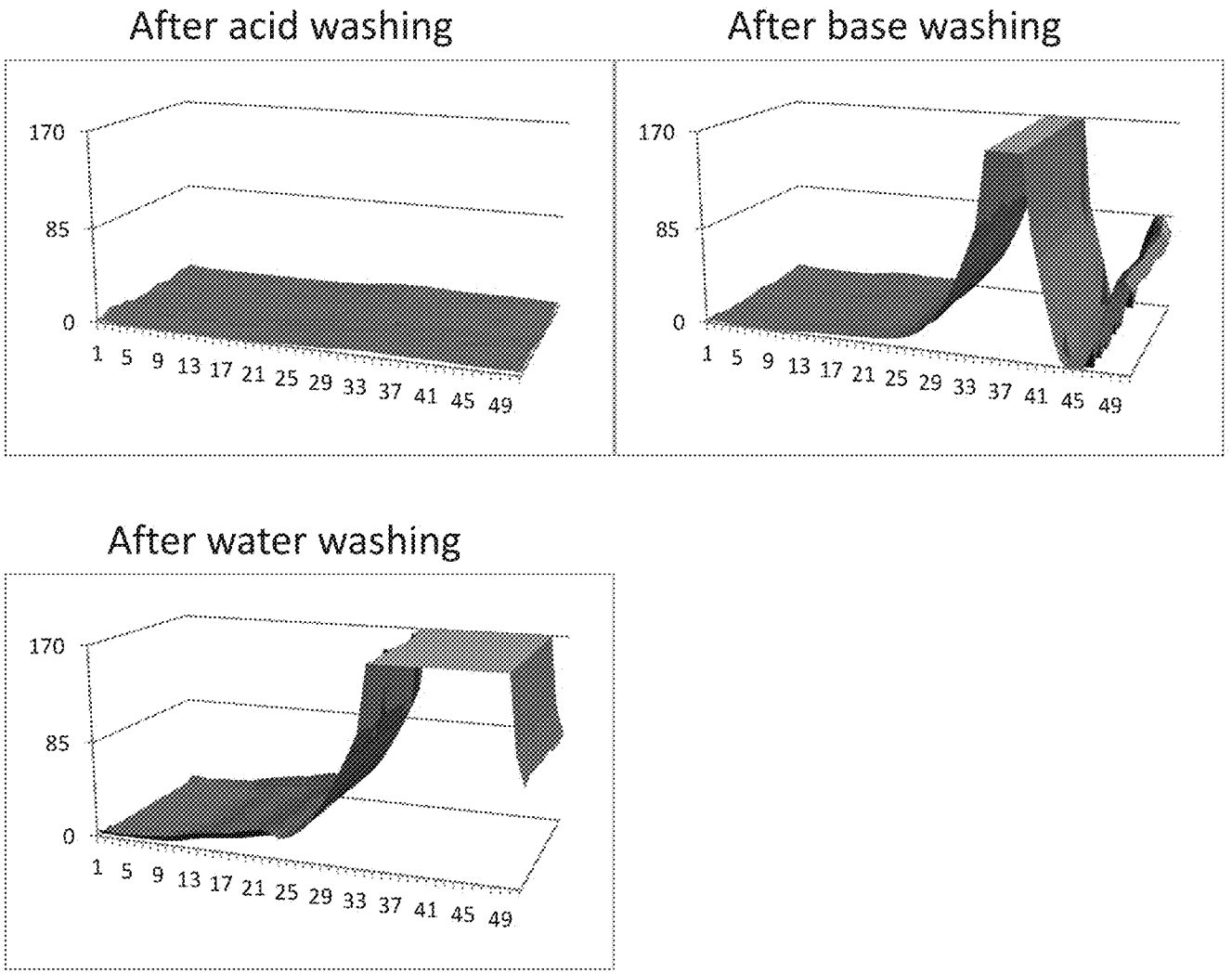
FIG. 8 shows the deposit thickness profile from JFTOT™ testing of the blend of jet fuel components from FIG. 7 after various types of additional treatment.

FIG. 8 shows results from additional JFTOT™ testing of the blend of jet fuel components from FIG. 7 after performing three different types of processing on the blend. The left plot in FIG. 8 corresponds to the deposit thickness from JFTOT™ testing at 260° C. after acid washing the blend. The middle plot corresponds to the deposit thickness after washing under alkaline conditions. The right plot corresponds to the deposit thickness after performing a water wash at a relatively neutral pH. As shown in FIG. 8, water washing had little or no impact on the deposit thickness profile. Treatment with an alkaline or base solution somewhat narrowed the peak for deposit thickness. The left plot, however, shows substantially different results based on acid washing of the blend. After acid washing, the blend of jet fuel components appeared to have a breakpoint of 260° C. or more based on deposit thickness. Additionally, the deposit thickness profile shows little or no deposit thickness at any location along the surface of the heating tube.

Figure 9:
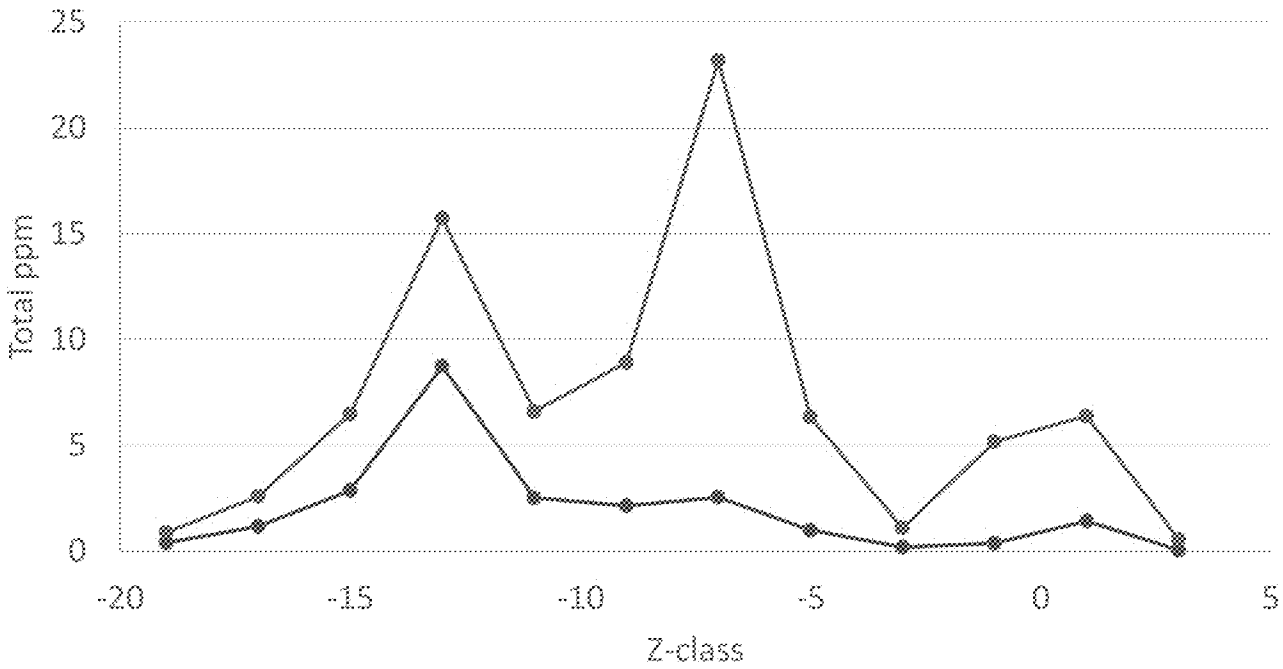
FIG. 9 shows a PESI-FTICR-MS characterization of the content of nitrogen-containing compounds having various Z class values for the blend of jet fuel components from FIG. 7 and the acid washed blend from FIG. 8.
Figure 10:
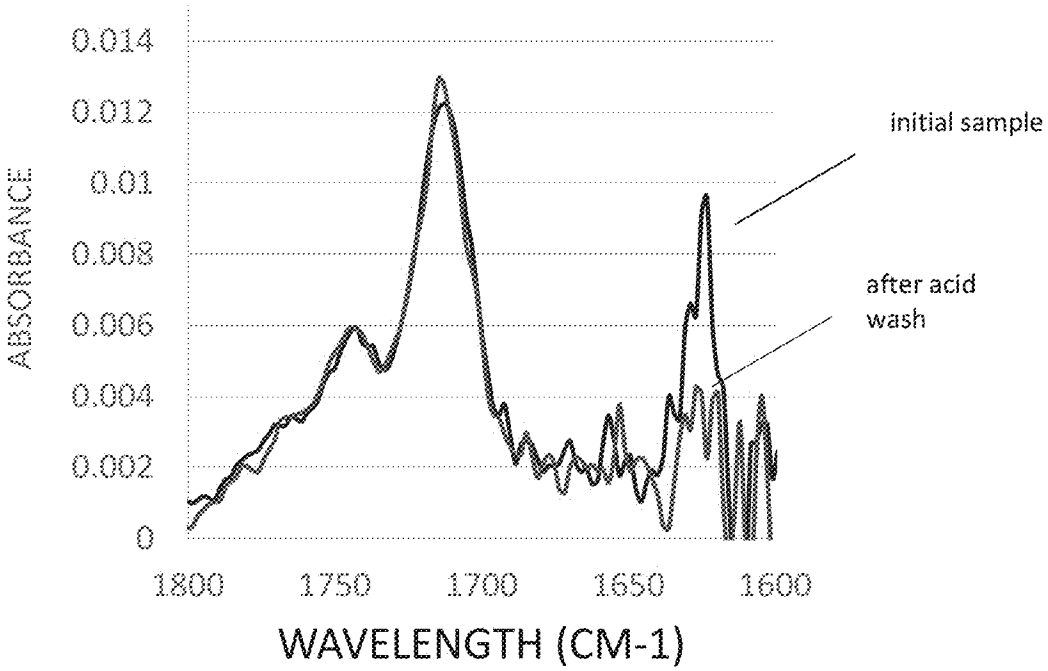
FIG. 10 shows a FTIR characterization of the blend of jet fuel components from FIG. 7 and the acid washed blend from FIG. 8.

FIGS. 9 and 10 show additional characterizations of the initial jet fuel component blend and the acid washed blend from FIGS. 7 and 8. In FIG. 9, PESI-FTICR-MS was used to characterize the content of nitrogen-containing compounds having various Z class values for both the initial blend and the acid washed blend. As shown in FIG. 9, amine content present in the initial jet fuel blend was reduced to less than 1 wppm, while the quinoline and pyridine content was also substantially reduced. It is noted that the content of nitrogen-containing compounds with a Z class of −10 or less (including quinolines) is about 5.0 molecular wppm or more, or about 7.0 molecular wppm or more, or about 10 molecular wppm or more. It is believed that a sample with a still higher initial nitrogen content could have a correspondingly greater content of compounds with a Z class of −10 or less. FIG. 10 provides a further illustration of this change between the initial jet fuel blend and the acid treated blend based on solid phase extraction Fourier transform infrared spectroscopy. As shown in FIG. 10, the infrared absorption profiles of both the blend and the acid washed blend are similar for the wave numbers shown with the exception of the region between 1650 $cm^{-1}$ and 1600 $cm^{-1}$. In that region, a substantial peak present in the initial jet fuel blend is missing in the acid washed sample.

Additional Embodiments

Embodiment 1

A method for preparing a jet fuel boiling range product, comprising: forming a jet fuel boiling range blend comprising a first component and a second component, the first component having a breakpoint of a first breakpoint temperature or more and the second component having a breakpoint of a first breakpoint temperature or more, the jet fuel boiling range blend having a sulfur content of about 500 wppm or more, a first nitrogen content, and a breakpoint of less than the first breakpoint temperature; and treating the jet fuel boiling range blend to produce a treated blend having a second nitrogen content that is less than the first nitrogen content and having a breakpoint of at least the first breakpoint temperature.

Embodiment 2

The method of Embodiment 1, wherein a) the first nitrogen content comprises about 5.0 wppm or more of nitrogen (or about 10 wppm or more) and the second nitrogen content comprises less than 5.0 wppm of nitrogen; b) the first nitrogen content comprises about 5.0 molecular wppm or more of nitrogen compounds having a Z class of +3 (or about 10 molecular wppm or more, or about 15 molecular wppm or more) and the second nitrogen content comprises about 1.0 molecular wppm or less of nitrogen compounds having a Z class of +3; c) the first nitrogen content comprises about 5.0 molecular wppm or more of nitrogen compounds having a Z class of +1 (or about 10 molecular wppm or more, or about 15 molecular wppm or more) and the second nitrogen content comprises about 1.0 molecular wppm or less of nitrogen compounds having a Z class of +1; d) the first nitrogen content comprises about 2.0 molecular wppm or more of nitrogen compounds having a Z class of +3 and about 5.0 molecular wppm or more of nitrogen compounds having a Z class of +1 (or about 10 molecular wppm or more, or about 15 molecular wppm or more), the second nitrogen content comprising about 1.0 molecular wppm or less of nitrogen compounds having a Z class greater than 0; or e) a combination of two or more of a), b), c), and d).

Embodiment 3

A method for preparing a jet fuel boiling range product, comprising: treating a first jet fuel boiling range fraction having a first nitrogen content to form a first treated component having a second nitrogen content, the first jet fuel boiling range fraction having a breakpoint of at least a first breakpoint temperature; and forming a jet fuel boiling range blend comprising the first treated component and a second component, the second component comprising a sulfur content of about 700 wppm or more and having a breakpoint of the first breakpoint temperature or more, the jet fuel boiling range blend having a sulfur content of at least 500 wppm and a breakpoint of at least the first breakpoint temperature, wherein a) the first nitrogen content comprises about 5.0 wppm or more of nitrogen (or about 10 wppm or more) and the second nitrogen content comprises less than 5.0 wppm of nitrogen; b) the first nitrogen content comprises about 5.0 molecular wppm or more of nitrogen compounds having a Z class of +3 (or about 10 molecular wppm or more, or about 15 molecular wppm or more) and the second nitrogen content comprises about 1.0 molecular wppm or less of nitrogen compounds having a Z class of +3; c) the first nitrogen content comprises about 5.0 molecular wppm or more of nitrogen compounds having a Z class of +1 (or about 10 molecular wppm or more, or about 15 molecular wppm or more) and the second nitrogen content comprises about 1.0 molecular wppm or less of nitrogen compounds having a Z class of +1; d) the first nitrogen content comprises about 2.0 molecular wppm or more of nitrogen compounds having a Z class of +3 and about 5.0 molecular wppm or more of nitrogen compounds having a Z class of +1 (or about 10 molecular wppm or more, or about 15 molecular wppm or more), the second nitrogen content comprising about 1.0 molecular wppm or less of nitrogen compounds having a Z class greater than 0; or e) a combination of two or more of a), b), c), and d).

Embodiment 4

The method of any of the above embodiments, wherein the treating comprises at least one of adsorbent treating, acid treating, and hydroprocessing.

Embodiment 5

The method of any of the above embodiments, wherein the first breakpoint temperature is 260° C. or more, or 270° C. or more, or 285° C. or more.

Embodiment 6

The method of any of the above embodiments, wherein the jet fuel boiling range blend has an initial boiling point of about 140° C. or more and a final boiling point of about 300° C. or less, or wherein the jet fuel boiling range blend has a T10 distillation point of about 205° C. or less, or a combination thereof.

Embodiment 7

The method of any of the above embodiments, wherein the first component (first treated component) and the second component have an initial boiling point of about 140° C. or more and a final boiling point of about 300° C. or less, or wherein the first component (first treated component) and the second component have a T10 distillation point of about 205° C. or less, or a combination thereof.

Embodiment 8

The method of any of the above embodiments, wherein the first component and the second component, prior to the treatment of the first component, have micro-separometer ratings of 85 or more; or wherein the jet fuel boiling range blend, prior to treatment of the jet fuel boiling range blend, has a micro-separometer rating of 85 or more.

Embodiment 9

The method of any of the above embodiments, wherein the jet fuel boiling range blend has a sulfur content of about 700 wppm or more, or about 1000 wppm or more.

Embodiment 10

The method of any of the above embodiments, wherein the second component comprises a sulfur content of about 1000 wppm or more, or about 1500 wppm or more.

Embodiment 11

The method of any of the above claims, wherein the first component has a breakpoint equal to the first breakpoint temperature, wherein the second component has a breakpoint equal to the first breakpoint temperature, or a combination thereof.

Embodiment 12

A jet fuel composition having an initial boiling point of about 140° C. or more, a final boiling point of about 300° C. or less, a breakpoint of about 260° C. or more, a sulfur content of about 500 wppm or more, about 5.0 molecular wppm or more of nitrogen-containing compounds having a Z class of −10 or less, and about 1.0 molecular wppm or less of nitrogen-containing compounds having a Z class greater than 0.

Embodiment 13

A jet fuel composition having an initial boiling point of about 140° C. or more, a final boiling point of about 300° C. or less, a breakpoint of 260° C. or more, a sulfur content of about 500 wppm or more, a nitrogen content of about 10 wppm or more, and about 1.0 molecular wppm or less of nitrogen-containing compounds having a Z class greater than 0.

Embodiment 14

A jet fuel composition made by the process comprising: forming a jet fuel boiling range blend comprising a first component and a second component, the first component and the second component having a breakpoint of 260° C. or more, the jet fuel boiling range blend having a sulfur content of at least 500 wppm, a first nitrogen content, and a breakpoint of less than 260° C.; and treating the jet fuel boiling range blend to produce a treated blend having a second nitrogen content that is less than the first nitrogen content and having a breakpoint of 260° C. or more.

Embodiment 15

The jet fuel composition of Embodiment 14, wherein a) the first nitrogen content comprises about 5.0 wppm or more of nitrogen (or about 10 wppm or more) and the second nitrogen content comprises less than 5.0 wppm of nitrogen; b) the first nitrogen content comprises about 5.0 molecular wppm or more of nitrogen compounds having a Z class of +3 (or about 10 molecular wppm or more, or about 15 molecular wppm or more) and the second nitrogen content comprises about 1.0 molecular wppm or less of nitrogen compounds having a Z class of +3; c) the first nitrogen content comprises about 5.0 molecular wppm or more of nitrogen compounds having a Z class of +1 (or about 10 molecular wppm or more, or about 15 molecular wppm or more) and the second nitrogen content comprises about 1.0 molecular wppm or less of nitrogen compounds having a Z class of +1; d) the first nitrogen content comprises about 2.0 molecular wppm or more of nitrogen compounds having a Z class of +3 and about 5.0 molecular wppm or more of nitrogen compounds having a Z class of +1 (or about 10 molecular wppm or more, or about 15 molecular wppm or more), the second nitrogen content comprising about 1.0 molecular wppm or less of nitrogen compounds having a Z class greater than 0; or e) a combination of two or more of a), b), c), and d).

Embodiment 16

A jet fuel composition made by the process comprising: treating a first jet fuel boiling range fraction having a first nitrogen content to form a first treated component having a second nitrogen content, the first jet fuel boiling range fraction having a breakpoint of 260° C. or more; and forming a jet fuel boiling range blend comprising the first treated component and a second component, the second component comprising a sulfur content of about 700 wppm or more and having a breakpoint of 260° C. or more, the jet fuel boiling range blend having a sulfur content of at least 500 wppm and a breakpoint of 260° C. or more, wherein a) the first nitrogen content comprises about 5.0 wppm or more of nitrogen (or about 10 wppm or more) and the second nitrogen content comprises less than 5.0 wppm of nitrogen; b) the first nitrogen content comprises about 5.0 molecular wppm or more of nitrogen compounds having a Z class of +3 (or about 10 molecular wppm or more, or about 15 molecular wppm or more) and the second nitrogen content comprises about 1.0 molecular wppm or less of nitrogen compounds having a Z class of +3; c) the first nitrogen content comprises about 5.0 molecular wppm or more of nitrogen compounds having a Z class of +1 (or about 10 molecular wppm or more, or about 15 molecular wppm or more) and the second nitrogen content comprises about 1.0 molecular wppm or less of nitrogen compounds having a Z class of +1; d) the first nitrogen content comprises about 2.0 molecular wppm or more of nitrogen compounds having a Z class of +3 and about 5.0 molecular wppm or more of nitrogen compounds having a Z class of +1 (or about 10 molecular wppm or more, or about 15 molecular wppm or more), the second nitrogen content comprising about 1.0 molecular wppm or less of nitrogen compounds having a Z class greater than 0; or e) a combination of two or more of a), b), c), and d).

Embodiment 17

The jet fuel composition of any of Embodiments 12-16, wherein the breakpoint of the jet fuel composition is 270° C. or more, or 285° C. or more.

Embodiment 18

The jet fuel composition of any of Embodiments 12-17, wherein the jet fuel composition comprises about 700 wppm or more of sulfur, or about 1000 wppm or more.

Embodiment 19

A jet fuel composition formed according to any of Embodiments 1-11.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains.

The present invention has been described above with reference to numerous embodiments and specific examples. Many variations will suggest themselves to those skilled in this art in light of the above detailed description. All such obvious variations are within the full intended scope of the appended claims.

The invention claimed is:

1. A method for preparing a jet fuel boiling range product, comprising:

providing an untreated first jet fuel boiling range component having a nitrogen content and a breakpoint temperature according to ASTM D3241 of 260° C. or more, treating the untreated first jet fuel boiling range component, wherein the treated first jet fuel boiling range component has a nitrogen content and a breakpoint temperature according to ASTM D3241 of 260° C. or more;

providing a second jet fuel boiling range component having a sulfur content of about 700 wppm or more and having a breakpoint temperature according to ASTM D3241 of 260° C. or more, blending the treated first jet fuel boiling range component and the second jet fuel boiling range component to form a jet fuel boiling range product having a breakpoint according to ASTM D3241 of 260° C. or more, and a sulfur content of at least 500 wppm, and wherein blending the untreated first jet fuel boiling range component with the second jet fuel boiling range component results in a jet fuel boiling range product having a breakpoint according to ASTM D3241 of less than 260° C., wherein a) the untreated first jet fuel boiling range component has a nitrogen content of about 5.0 wppm or more of nitrogen and the treated first jet fuel boiling range component has a nitrogen content of less than 5.0 wppm of nitrogen; b) the untreated first jet fuel boiling range component has a nitrogen content of about 5.0 molecular wppm or more of nitrogen compounds having a Z class of +3 and the treated first jet fuel boiling range component has a nitrogen content of about 1.0 molecular wppm or less of nitrogen compounds having a Z class of +3; c) the untreated first jet fuel boiling range component has a nitrogen content of about 5.0 molecular wppm or more of nitrogen compounds having a Z class of +1 and the treated first jet fuel boiling range component has a nitrogen content of about 1.0 molecular wppm or less of nitrogen compounds having a Z class of +1; d) the untreated first jet fuel boiling range component has a nitrogen content of about 2.0 molecular wppm or more of nitrogen compounds having a Z class of +3 and about 5.0 molecular wppm or more of nitrogen compounds having a Z class of +1, the treated first jet fuel boiling range component has a nitrogen content of about 1.0 molecular wppm or less of nitrogen compounds having a Z class greater than 0; or e) a combination of two or more of a), b), c), and d); and wherein the jet fuel boiling range blend has an initial boiling point of about 140° C. or more and a final boiling point of about 300° C. or less, or wherein the jet fuel boiling range blend has a T10 distillation point of about 205° C. or less, or a combination thereof.

2. The method of claim 1 wherein the treating comprises at least one of adsorbent treating, acid treating, and hydroprocessing.

3. The method of claim 1, wherein the first component and the second component, prior to the treatment of the first component, have micro-separometer ratings of 85 or more; or wherein the jet fuel boiling range blend, prior to treatment of the jet fuel boiling range blend, has a micro-separometer rating of 85 or more.

4. The method of claim 1, wherein the jet fuel boiling range blend has a sulfur content of about 700 wppm or more.

5. The method of claim 1, wherein the second component comprises a sulfur content of about 1000 wppm or more.

* * * * *